US005494136A

United States Patent [19]

Humble

[11] Patent Number: 5,494,136

[45] Date of Patent: Feb. 27, 1996

[54] INTEGRATED AUTOMATED RETAIL CHECKOUT TERMINAL

[76] Inventor: David R. Humble, 2696 Emerald Way North, Deerfield Beach, Fla. 33441

[21] Appl. No.: 463,004

[22] Filed: Jun. 5, 1995

Related U.S. Application Data

[63] Continuation of Ser. No. 102,632, Aug. 5, 1993, abandoned.

[51] Int. Cl.[6] ..... A47F 9/04

[52] U.S. Cl. ..... 186/61; 235/383

[58] Field of Search ..... 186/52, 59, 60, 186/61, 68, 69; 235/383; 358/108

[56] References Cited

U.S. PATENT DOCUMENTS

| | | | |
|---|---|---|---|
| 3,688,873 | 9/1972 | Potrafke | 186/59 X |
| 4,676,343 | 6/1987 | Humble et al. | 186/61 |
| 4,779,706 | 10/1988 | Mergenthaler | 186/61 |
| 4,792,018 | 12/1988 | Humble et al. | 186/61 |
| 4,940,116 | 7/1990 | O'Connor et al. | 186/61 |
| 4,964,053 | 10/1990 | Humble | 235/383 X |
| 5,115,888 | 5/1992 | Schneider | 186/61 |
| 5,168,961 | 12/1992 | Schneider | 186/52 |

*Primary Examiner*—David A. Bucci
*Assistant Examiner*—Scott L. Lowe
*Attorney, Agent, or Firm*—Eckert Seamans Cherin & Mellott

[57] ABSTRACT

An automated retail checkout system includes scanning terminals operable by either customers or store personnel, and payment terminals which service a number of scanning terminals. The scanning terminal communicates with a central processor for determining prices from the coded identities of products. Electronic payment can be optionally accepted at the scanning terminal, or a transaction is opened there and closed when payment is accepted at a payment terminal, also coupled to the central processor. Video monitoring allows the image of the products being scanned to be compared with the image expected from their scanned code, for identifying any discrepancy.

16 Claims, 2 Drawing Sheets

INTEGRATED AUTOMATED RETAIL CHECKOUT TERMINAL

CROSS REFERENCE TO RELATED APPLICATION

This is a continuation of application Ser. No. 08/102,632, filed Aug. 5, 1993, now abandoned.

BACKGROUND OF THE INVENTION

1. Field of the Invention

The invention relates to the field of terminals and terminal systems for retail checkout of products purchased by consumers. More particularly, the invention provides a retail checkout terminal system which can be operated by store personnel and by the consumer, providing a system of integrated cashier and self-checkout terminals on a single network coupled to a single central processor.

2. Prior Art

Retail stores such as supermarkets generally have one or more checkout lanes, each of which is equipped with an electronic cash register operated by a cashier. Although there are variations, the cashier typically operates a keyboard and/or scanner to log into memory the identity or price of each item presented for purchase by the customer, who simply waits. To complete the transaction, the cashier logs the amount presented by the customer, makes change from a cash drawer, and provides the customer with a receipt. In the event of a credit transaction or payment by electronic means, the cashier typically handles the communications needed to verify acceptance of the payment, also using the cashier's keyboard.

Most electronic cash registers are coupled to a back-room computer processor that manages the electronic cash registers in all checkout lanes. In this manner, price changes, promotions and the like can be arranged centrally, i.e., without altering the programming of a plurality of terminals on the system. The combination of a number of electronic cash registers and the computer processor form what is commonly known as a "point-of-sale-system".

Many retail stores and most major supermarkets are equipped with bar-code scanners that scan the Universal Product Code (UPC) or other code on each item presented for purchase. This code is electronically indexed to price information in the store's point-of-sale computer processor. The price of a scanned item is usually displayed, and added to a running sum, which is used to determine the final bill for the shopper.

It is of course desirable and a function of a computer system to minimize the work required by cashiers and other human attendants. However, problems are presented if one attempts to eliminate the cashier and to fully automate the checkout procedure. For example, some items have missing or damaged UPC codes. Some items such as produce items are in bulk and are priced by weight. Furthermore, making change and other aspects of payment present security dangers, or if automated with currency readers or the like are unwieldy and inconvenient.

It is known to provide "self-checkout" machines that allow shoppers to scan their own items to determine prices before visiting the cashier. It is also known to allow the consumer to scan their items at the actual checkout, with the machine performing scanning, indexing and totalling functions. The shopper then takes the indicia generated by the scanning station and pays at a central cashier. Such scanning stations can be equipped with security checking features, such as a scale or dimensional scanning means, enabling the items presented to be cross checked against the expected size and weight of the item, as stored in memory. Store personnel intervene from time to time to help shoppers, e.g. who present items that do not have bar codes or who otherwise need help with the self-checkout process.

The majority of items sold in retail stores today contain bar-coded universal product codes (UPC) and are scanned during checkout. The price for items that do not contain bar-codes must be determined by the cashier and entered manually. Alternatively, a store code is entered which triggers the store computer to determine the price. Variable weight items such as produce are weighed by the cashier or other store personnel using an electronic scale having an output coupled to the electronic cash register. The item code number representing the type of item is entered in the electronic cash register, and the price is established.

The conventional, cashier operated, point of sale system requires an electronic cash register at each lane, a local area network over which all electronic cash registers communicate, and a central processor that contains a file of all items in the store and software to determine pricing and to do the arithmetic and other functions required to conduct a transaction and deliver management reports. The functions of the electronic cash registers and the central computer can be divided in a variety of ways, e.g., with either or both of the electronic cash register and the central processor containing pricing information indexed to product codes and accumulating summary information.

A self-checkout point of sale system is programmed differently and requires other or different component elements in addition to those required in a cashier operated point of sale system. For self-checkout, a number of self-checkout machines (determined by the store) are provided in conjunction with conventional cashier-operated checkout lanes. The self-checkout machines are linked to a separate local area network, and a separate and independent central processor is required to handle the self-checkout functions.

Approximately one electronic cash register is required for processing payments from customers at three self-checkout lanes, to ensure that the electronic cash register at a payment station does not become a bottleneck. Therefore, even if all the customers of a store are required to use self-checkout lanes rather than cashier operated lanes (i.e., if the only cashier operated machines are payment stations), the store still needs a full complement of conventional point of sale network equipment (for both the cashier operated payment stations and the self-checkout lanes), and saves only two-thirds of the electronic cash registers.

It will be appreciated that a major problem with the addition of self-checkout lanes to a conventional point of sale equipped store is the substantial investment needed to cover the cost of the self-checkout equipment in addition to the cost of conventional point of sale equipment. There is considerable hardware redundancy, particularly in the local area networks and the central processors. Even given the fact that self-checkout systems reduce the need for staff, the time required to amortize the investment in self-checkout equipment is often lengthy.

There is also a problem with procedural inefficiencies inherent in having two systems (self-checkout and conventional checkout) operating in one store. Different systems of handling produce and cash are needed. In addition, employees having different training or skill levels are required. In a mix of conventional and self-checkout lanes, all of the operators preferably are trained as cashiers so that they may either assist with self checkout or man a cashier station. In addition, the proportionate mix of self-checkout machines and conventional lanes is fixed, which limits flexibility should the store have a long or short term need for either more conventional lanes or more self-checkouts.

Further, a security problem is raised in providing a large number of persons who can function as cashiers. Each cashier in a conventional lane has access to cash. The more employees having access to cash, the greater the security problem.

As fewer entry level workers enter the labor market in the coming years, there is an impending shortage of workers of the type generally employed by retailers in low level cashier and checkout related positions. In addition, the daily, and in many cases hourly, variability consumer shopping patterns makes labor scheduling difficult for retailers. Conventional cashier operated checkout is limited in that employees must be present to operate the system. It is difficult for store management to accurately predict store traffic. Checkout line backups form at some times, although at times checkout employees stand idle for lack of customers.

The increase in the minimum wage puts additional pressure on retailers to control labor hours. The combination of fewer available workers at higher cost, along with the difficulty of scheduling the proper number of employees to accommodate the number of shoppers in the store, suggests that a system which employs the maximum amount of self-checkout capability along with maximum utilization employee labor offers the greatest return on invested capital.

There is a need for a checkout system that has the capability to checkout consumers in all lanes at all times while the store is open. Such a system would provide the benefits of both conventional checkout and self-checkout, yet deliver checkout capability at a lower equipment cost than the aggregate of the two systems as currently configured. It is also desirable that the system handle other financial transactions and incorporate electronic marketing functions in an integrated arrangement.

SUMMARY OF THE INVENTION

It is an object of the invention to provide an automated retail checkout system having terminals which can be operated in either a conventional cashier operated mode or a self-checkout mode.

It is another object of the invention to provide an automated retail checkout system that is compatible with existing conventional and self-checkout systems.

It is a further object of the invention to provide an automated retail checkout system which provides faster checkout of shoppers than conventional checkout systems.

It is yet another object of the invention to provide an automated retail checkout system which permits both conventional and self-checkout at approximately the same cost of equipment as a single checkout system, and in particular does not require redundant communication and processor arrangements.

It is still another object of the invention to provide an automated retail checkout system that improves store security.

These and other objects are accomplished by an automated retail checkout system comprising memory means for storing prices of products available for purchase; a scanning station having scanning means for determining identities of products being purchased; process or means in communication with the memory means and the scanning means for retrieving the prices of the products being purchased and calculating a total; communication means for communicating the total to a payment station; conveyor means for moving the items being purchased from the scanning means to a bagging receptacle; video means for displaying a video image of the products being purchased; and security means for identifying any discrepancy between the products being purchased as displayed by the video means and the products being purchased as determined by the scanning means.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
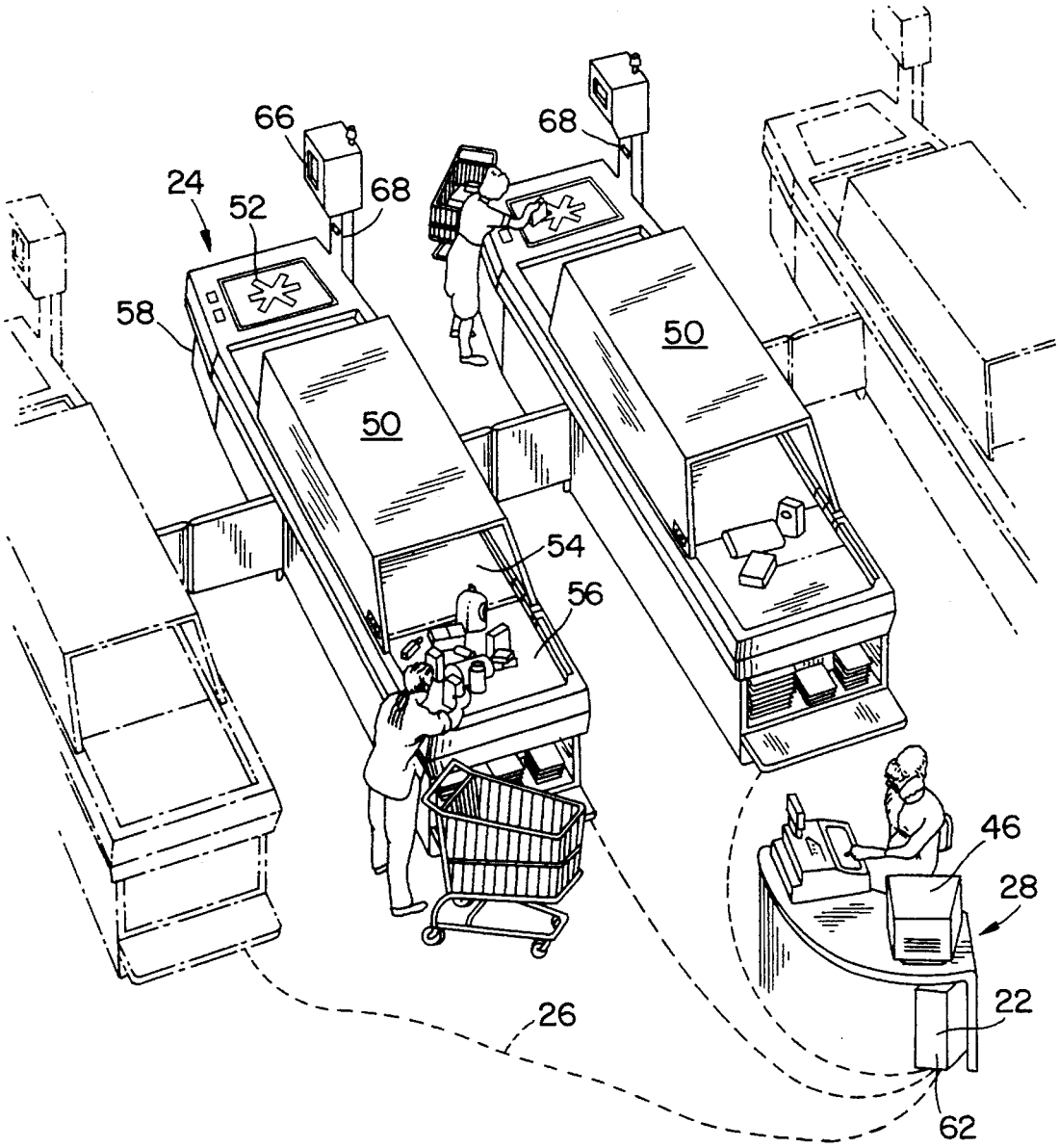
FIG. 1 is a schematic plan view of a scanning station according to the invention.

The integrated automatic terminal system of the invention consists essentially of one central processor 22, checkout terminals 24 coupled to the central processor 22 on a network 26, and payment stations 28. Consumers commence the checkout procedure by going to a checkout terminal 24 where items are scanned and pricing information respecting the items is accumulated. In the self-checkout mode the consumer scans his or her own items. In the cashier mode the articles are scanned by store personnel. After the scanning process, the consumer can proceed to a payment station 28 for completion of a cash or credit card transaction. Alternatively, the checkout terminal 24 can be equipped to accept payment by an electronic payment method such as a bank debit card, an integrated circuit card or the like. Bulk and other non-bar coded items can be handled by a store intervention method using video input means 42 for determining the nature of an uncoded item, coupled to a viewing means in the form of a service terminal display 46. The video input means 42 and the service terminal display 46 are coupled to one or more payment stations 28 whereby one or more store employees can service missing codes at a number of stations. The central processor 22 can arrange to switchably couple the image from a selected checkout terminal 24 to the service terminal display 46, for example when the scanner 52 fails to read a valid product code. The central processor 22 then communicates the price and/or identity information for the product, as input by the store personnel remotely, to the checkout terminal 24.

It is also possible to provide means for accepting cash payment at the checkout terminal 24, provided such means is disabled when the station is being used for self-checkout, and enabled when the station is being operated by store personnel. The central processor 22 can be programmed to switch the checkout terminal 24 between store personnel and customer operation modes, for example locking a cash drawer 80 and disabling certain keyboard 82 functions in the self-checkout mode. The station can be switched between modes, for example, using a password logon procedure for store personnel, or by key switch means or the like.

Whereas the checkout terminal 24 does not need a cashier, all checkout terminals 24 can be open all the time. The store management decides how many terminals 24 to man with store personnel to perform conventional checkout service. The balance of the terminals 24 automatically revert to operation in self-checkout mode. The primary advantage of this system is a substantial increase in open lane hours the store is able to provide with a given number of store personnel. More open lane hours allows a higher checkout throughput as more consumers arriving simultaneously at the checkout area can check out at the same time. In a conventional checkout system, lanes not operated by store personnel are necessarily closed.

An establishment equipped with an integrated automatic checkout system has several options. A number of the terminals 24 may be operated by store personnel to provide conventional checkout, i.e., with the scanner and input means operated wholly by store personnel. The balance of the lanes operate as self-checkout terminals where a transaction can be opened, and thereafter completed upon acceptance of payment by store personnel operating one or more payment stations 28 disposed apart from the checkout terminals 24. With this option the store reduces the number of consumers waiting in line when consumers ready to check out exceeds the number of store personnel operating checkout terminals 24.

Several terminals 24 may be operated by store personnel to provide conventional checkout while the balance of the lanes, although arranged to operate as self-checkout terminals, are designated for "electronic payment only". With this option the store has more open lane hours and improved through put without increase in the number of store personnel needed, as compared to conventional checkout.

All terminals may operate as self-checkout during night hours or at times when a limited number of store personnel are available.

One or more terminals 24 may be designated as electronic payment and the others handled by the payment station(s) 28. With this option the store may operate with as little as one store employee performing the checkout payment processing function.

All terminals 24 may be operated for conventional checkout by store personnel during peak checkout periods. With this option the store has increased checkout throughput compared to conventional checkout stores because only scanning is performed at the checkout terminal 24 instead of scanning and payment. In the integrated automatic checkout terminal equipped store, the payment function is performed in parallel with scanning, i.e., with the payment terminals 28 operating at the same time as the scanners 52, processing payments for previously scanned customers. In a conventional system the payment functions are idle during scanning and the scanning functions are idle while processing payments. By operating the functions simultaneously using store personnel, throughput can be increased approximately 30%, and more efficient use is made of the available hardware. This efficiency, however, comes with a requirement for additional store personnel, as all scan lanes must be operated by store personnel plus the additional personnel to operate the payment stations. However, the added throughput is equivalent to 30% more lane capacity, and is a valuable option during peak demand periods.

Figure 2:
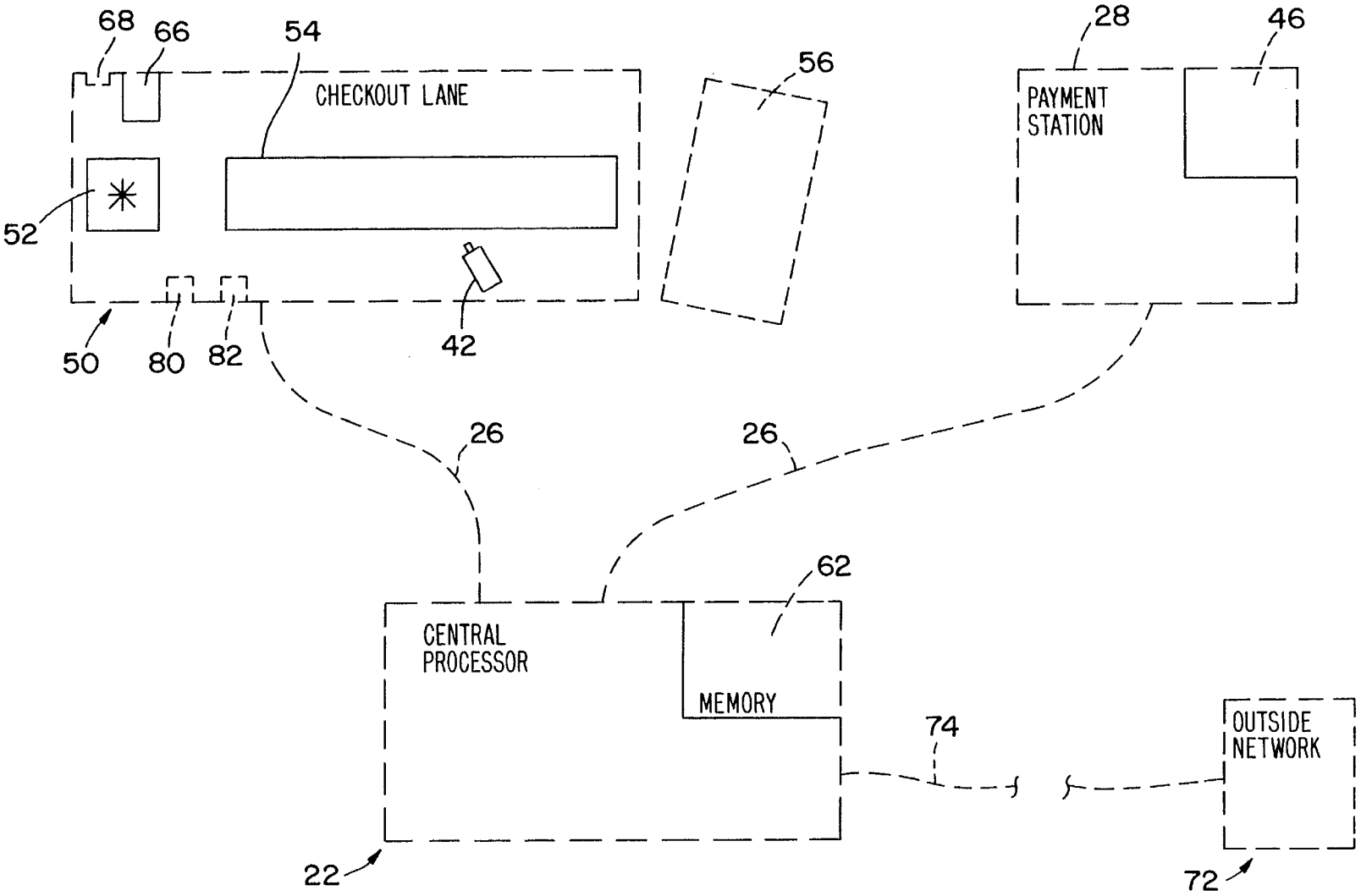
FIG. 2 is a functional schematic diagram of an integrated automatic checkout terminal system according to the invention.

As shown physically in FIG. 1 and by functional schematic in FIG. 2, the checkout lane 50 for operation by either the customer or the store personnel has a scanning portion 52, preferably a transport 54, and a bagging receptacle 56. All items to be purchased are scanned by an optical scanner, for example mounted in the counter or cabinet 58, and logged into memory 62. The scanner 52 is coupled for data communications with the central processor 22 for obtaining price information and the like. The prices are accumulated to calculate the total and displayed and/or printed at the checkout terminal 24, for example being presented on customer display 66. This display 66 is also useful for providing instructions to the customer, and can also be a touch screen display enabling the customer to select options presented during the checkout procedure. The checkout terminal 24 preferably includes means 68 for accepting payment at least in electronic form such as by bank card, debit card or the like whereby financial transactions can be completed, normally requiring data communication with an outside network 72 by phone or radio communication 74. Coupon transactions can also be completed at the scanning station 24, e.g., by enabling bar coded coupons to be scanned for automatic comparison with the codes of the items presented, thereby automatically crediting the coupon amount against the accumulated total for the transaction.

As shown in FIG. 2, bagging receptacle 56 preferably mates with the checkout terminal 24 and accumulates items purchased after they pass the scanner 52. At the completion of scanning the entire transaction of items, the bagging receptacle 56 may be moved to the payment station 28. Alternatively, the bagging receptacle 56 can be fixed and simply used to hold the items temporarily until bagged.

Payment station 28 is operated only by store personnel. The payment station collects cash and other forms of payment from consumers leaving the checkout terminal 24, and allows transactions which have been opened by scanning to be closed, i.e., completed.

The checkout terminals 24 and payment stations 28 are coupled in data communication with the central processor 22. A local communications network 26 links these elements such that product code data can be communicated from the scanner 52 to the central processor 22, and price data returned, and so that payment transactions can be completed to close transactions. The central processor 22 manages the integrated automatic terminal system, handles storage of data, and preferably handles communications links to the outside.

A security and information system is provided for monitoring automatic checkout. Using video camera 42, products that are scanned can be compared to the expected image of the item to ensure that the code of the item scanned corresponds to that of the item purchased. The video image thus captured can be checked using image processing software. Preferably, the video image data is monitored by store personnel, either continuously or on a sampled basis. The video also provides two way communications between the consumer at the lane and a centrally located store employee at the service terminal 28. In the event of an item without a bar code or an item requiring special handling, the store employee can identify the item and/or enter the price and description directly to that lane.

The invention having been disclosed, a number of variations will now become apparent to persons skilled in the art. The invention is intended to encompass not only the preferred examples as explained in detail, but also reasonable equivalents and variants consistent therewith. Accordingly, reference should be made to the appended claims rather than the foregoing examples in order to assess the scope of the invention in which exclusive rights are claimed.

I claim:

1. An automated retail checkout system, comprising:

at least one scanning checkout terminal for location at a checkout lane, including a scanner operable to read product identity information from coded labels on products presented for purchase;

a central processor coupled to the scanning checkout terminal, the central processor being coupled for data communication with the scanning checkout terminal, the central processor including a memory indexing price information with the product identity information, the central processor and the scanning terminal being operable in conjunction to accumulate a transaction total from a series of said products presented for purchase;

at least one of each of an attached payment checkout terminal and a remotely located payment checkout terminal also coupled in data communication with the central processor, each of the attached and the remotely located payment checkout terminals being operable to effect financial transactions including acceptance of payment for transactions initiated at the scanning checkout terminal, wherein the scanning checkout terminal is operable by customers and by store personnel, and the attached payment checkout terminal and the remotely located payment checkout terminal accept each payment and are operable by store personnel only;

at least one video output device operable by store personnel, the video output device being coupled to a video input device at the scanning checkout station, and wherein a service terminal is coupled in data communication with the central processor and operable by said store personnel to input at least one of price and identity information for a product presented for purchase at the scanning checkout terminal; and a bagging receptacle at the scanning checkout terminal and a transport for moving products from the scanner to the bagging receptacle.

2. The automated retail checkout system according to claim 1, comprising a plurality of said scanning checkout terminals and a smaller number of said remotely located payment checkout terminals.

3. The automated retail checkout system according to claim 1, further comprising security means associated with the scanning checkout terminal for comparing characteristics of products presented for purchase with known characteristics of products having product identity codes corresponding to a scanned product identity code.

4. The automated retail checkout system according to claim 3, comprising a plurality of said scanning checkout terminals, each including a video input device, and wherein the video output device is coupled to a selected one of the video input devices of said plurality of scanning checkout terminals under control of the central processor.

5. The automated retail checkout system according to claim 1, wherein the attached payment checkout terminal further comprises a cash drawer and a means for locking the cash drawer such that the cash drawer is accessible by store personnel only.

6. The automated retail checkout system according to claim 5, wherein the attached payment checkout terminal further comprises a keyboard coupled to the central processor, the keyboard being operable to preform functions available to both customers and store personnel as well as functions available only to store personnel, and means for disabling the keyboard such that functions available only to store personnel are not accessible by customers.

7. The automated retail checkout system according to claim 1, further comprising financial transaction means located at the scanning checkout terminal, the financial transaction means being operable to effect non-cash payment transactions.

8. The automated retail checkout system according to claim 7, wherein the financial transaction means is operable to accept electronic indication of payment, and further comprising communication means coupled between the central processor and an external banking network, the financial transaction means and the central processor being operable in conjunction to report and verify payment.

9. The automated retail checkout system according to claim 8, wherein the electronic indication of payment is one of a bank debit card, an integrated circuit card, and a personal identification card.

10. The automated retail checkout system according to claim 8, wherein the central processor and the scanning checkout terminal are operable to open a transaction upon a product being scanned at the scanning checkout terminal and to close the transaction upon acceptance of payment, and wherein the payment is made at one of the scanning checkout terminal, the attached payment checkout terminal, and the remotely located payment checkout terminal.

11. An automated retail checkout system, comprising:

at least one scanning checkout terminal for location at a checkout lane, including a scanner operable to read product identity information from coded labels on products presented for purchase;

a central processor coupled to the scanning checkout terminal, the central processor being coupled for data communication with the scanning checkout terminal, the central processor including a memory indexing price information with the product identity information, the central processor and the scanning terminal being operable in conjunction to accumulate a transaction total from a series of said products presented for purchase;

at least one payment checkout terminal also coupled in data communication with the central processor, the payment checkout terminal being operable to effect financial transactions including acceptance of payment for transactions initiated at the scanning checkout terminal, wherein the scanning checkout terminal is operable by customers and by store personnel, and the payment checkout terminal is operable by store personnel only;

at least one video output device operable by store personnel, the video output device being coupled to a video input device at the scanning checkout station, and wherein a service terminal is coupled in data communication with the central processor and operable by said store personnel to input at least one of price and identity information for a product presented for purchase at the scanning checkout terminal;

a bagging receptacle at the scanning checkout terminal and a transport for moving products from the scanner to the bagging receptacle wherein the bagging receptacle is movable between the scanning checkout terminal and the payment checkout terminal;

financial transaction means located at the scanning checkout terminal, the financial transaction means being operable to effect non-cash payment transactions and electronic indication of payment; and communication means coupled between the central processor and an external banking network, the financial transaction means and the central processor being operable in conjunction to report and verify payment;

wherein the central processor and the scanning checkout terminal are operable to open a transaction upon a product being scanned at the scanning checkout terminal and to close the transaction upon acceptance of payment, and wherein the payment is made at one of the scanning checkout terminal and the payment checkout terminal at the choice of a customer.

12. An automated retail checkout system, comprising:

at least one scanning checkout terminal for location at a checkout lane, including a scanner operable to read product identity information from coded labels on products presented for purchase;

a central processor coupled to the scanning checkout terminal, the central processor being coupled for data communication with the scanning checkout terminal, the central processor including a memory indexing price information with the product identity information, the central processor and the scanning terminal being operable in conjunction to accumulate a transaction total from a series of said products presented for purchase;

an attached payment checkout terminal and a remotely located payment checkout terminal also coupled in data communication with the central processor, the attached payment checkout terminal and the remotely located payment terminal being operable to effect financial transactions including acceptance of payment for transactions initiated at the scanning checkout terminal, wherein the scanning checkout terminal is operable by customers and by store personnel, and the attached payment checkout terminal and the remotely located payment terminal accept each payment and are operable by store personnel only;

at least one video output device operable by store personnel, the video output device being coupled to a video input device at the scanning checkout station, and wherein a service terminal is coupled in data communication with the central processor and operable by said store personnel to input at least one of price and identity information for a product presented for purchase at the scanning checkout terminal; and a bagging receptacle at the scanning checkout terminal and a transport for moving products from the scanner to the bagging receptacle.

13. A method for automated retail checkout, comprising the steps of:

storing prices of products available for purchase in a memory of a central processor, the prices being indexed in the memory to product identity codes;

providing a plurality of scanning checkout stations each having a scanner for reading the product identity codes of products presented by a customer for purchase at the scanning checkout station;

providing a transport means for moving products from the scanner to a bagging receptacle;

providing at least one of each of an attached payment station and a remotely located payment checkout station, the remotely located payment checkout station being disposed apart from the scanning stations, each of the attached and remotely located payment checkout stations being coupled to the central processor;

displaying on at least one service terminal a video image of products being scanned, and inputting remotely to the scanning checkout terminal at least one of price and identity code information;

opening a transaction and determining an identity of each product presented for the transaction by scanning an identity code thereon, retrieving a corresponding price from the memory, accumulating a transaction total price and reporting the transaction total price to the customer and to the central processor;

closing the transaction upon acceptance of payment in a form of one of electronic payment presented by the customer at the scanning checkout station and cash payment presented by the customer at one of the attached and the remotely located the payment checkout stations; and, wherein the scanning checkout station is operated by at least one of the customer and store personnel and the attached payment checkout station and the remotely located payment checkout station are operated exclusively by store personnel.

14. The method for automated retail checkout according to claim 13, further comprising displaying on at least one service terminal a video image of products being scanned, and comparing characteristics of the products being scanned with characteristics expected due to the identity code thereon, for detecting discrepancies.

15. The method for automated retail checkout according to claim 13, further comprising .manning at least some of the scanning checkout stations with store personnel for increasing throughput in times of high traffic.

16. The method for automated retail checkout according to claim 13, wherein at least one of the scanning checkout stations is designated exclusively for electronic payment, and further comprising communicating with an external financial network for verifying acceptance of payment, the transaction being closed upon acceptance of the electronic payment.

* * * * *